US005106102A

United States Patent [19]

Mitsumoto

[11] Patent Number: 5,106,102

[45] Date of Patent: Apr. 21, 1992

[54] PROJECTED IMAGE DRIVE GAME DEVICE

[75] Inventor: Kazuhiko Mitsumoto, Tokyo, Japan

[73] Assignee: Tomy Company, Ltd., Tokyo, Japan

[21] Appl. No.: 718,249

[22] Filed: Jun. 20, 1991

[30] Foreign Application Priority Data

Jun. 20, 1990 [JP] Japan ..... 2-162150
Aug. 20, 1990 [JP] Japan ..... 2-218450

[51] Int. Cl.[5] ..... A63F 9/14
[52] U.S. Cl. ..... 273/442
[58] Field of Search ..... 273/442; 434/32, 63

[56] References Cited

U.S. PATENT DOCUMENTS 3,060,597 10/1962 Gilbert ..... 273/442 X
3,270,439 9/1966 Davenport ..... 273/442 X
3,568,332 3/1971 Koci et al. ..... 273/442 X
4,059,266 11/1977 Nakamura ..... 273/442
4,167,822 9/1979 Weir et al. ..... 273/442 X
4,474,372 10/1984 Karasawa ..... 273/442
4,602,790 7/1986 Furukawa ..... 273/316
4,856,777 8/1989 Hirose et al. ..... 273/442
4,877,240 10/1989 Aoki ..... 273/442 X

FOREIGN PATENT DOCUMENTS 36-1239 1/1961 Japan .
1301620 1/1973 United Kingdom .

*Primary Examiner*—Paul E. Shapiro
*Attorney, Agent, or Firm*—Staas & Halsey

[57] ABSTRACT

A drive game device is provided with a steering wheel that controls the apparent movement of a model vehicle. The model vehicle is pivotally mounted on a vertical axis running through on a screen. A transparent running sheet is movably mounted above the screen. A light source is mounted above the transparent running sheet for projecting an image on the screen corresponding to a portion of a pattern on the transparent running sheet. A longitudinal drive power transmission transmits power from an electric motor to said transparent running sheet so that said transparent running sheet will selectively be driven to longitudinally move forward or backward, in accordance with the operating position of a gear shift lever and a direction of the steering wheel. A crosswise drive power transmission transmits the power from the electric motor to the light source so that the light source will transversely travel in the crosswise direction of the transparent running sheet in accordance with an amount of steering operation of the steering wheel.

20 Claims, 11 Drawing Sheets 55
56
60
61
81
85
191
77
X1
Y1
Y2
45°
90°
180°

PROJECTED IMAGE DRIVE GAME DEVICE

CROSS-REFERENCES TO RELATED APPLICATIONS

This application is related to U.S. Patent application 07/575,993, filed Aug. 31, 1990 and Great Britain design patent application No. 2009372, filed Aug. 31, 1991, both specifically incorporated herein by reference.

BACKGROUND OF THE INVENTION

1. Technical Field

The present invention relates to a drive game device wherein a moving body can freely make a relative movement in all directions, backward and forward and rightward and leftward, on a projected image corresponding to a projective part depicted on a transparent running sheet in accordance with the manipulation of a steering wheel.

2. Description of the Related Art

Such drive game devices are known in the prior art in which a model car is placed on a transparent running sheet which is driven in a specific direction, and guided magnetically in the direction of width of the transparent running sheet while making relative drive on the transparent running sheet by manipulating the steering wheel. For example, Japanese Utility Model Publication No. 36-1239 discloses a drive gear device.

These prior-art drive game devices, however, have such a problem that the direction of travel of the model car on the transparent running sheet by the manipulation of the steering wheel is limited to the direction of width, and therefore, unlike actual cars, vessels, aircraft and flying objects, it was impossible to change the direction of travel of the model car freely backward and forward and rightward and leftward, by means of the steering wheel.

SUMMARY OF THE INVENTION

It is an object of the present invention to solve the above-mentioned and other problems by providing a drive game device which is capable of freely changing the direction of travel of a model car, like actual cars, vessels, aircraft, and flying objects, backward and forward and rightward and leftward, by manipulating the steering wheel, so that a game player can enjoy the "you-are-there" realism that he or she feels as if actually driving a car.

Another object of the present invention is to provide a device where the moving body can freely run relative in all directions, backward and forward and rightward and leftward, with respect to the projected image corresponding to the projective part depicted on the transparent running sheet in accordance with the manipulation of the steering wheel.

A steering wheel 77 is mounted on a drive game device. A moving body 18 changes its direction of movement in accordance with the manipulation of the steering wheel 77. A transparent running sheet 191 having a pattern 192 such as a street is movably mounted above the moving body 81. A light source 144 is mounted, movable in the direction of the width of the transparent running sheet 191, above the transparent running sheet 191 in order to project an image of the pattern 192 on to the moving body 81 and a screen 85 around the moving body 81. The light source 144 is movable laterally across the width of the transparent running sheet 191 in order to selectively project a portion of the pattern 192 as the image on the screen 85. A rotating shaft 33, a crown gear 38, and a drive roller 60 transmit drive power from a motor 31 to the transparent running sheet 191 so that the transparent running sheet 191 can be selectively driven in any of forward and backward directions or stopped in accordance with the operating portion of the operating lever 8. A crosswise-drive rocking level 65, a crosswise-drive roller 61, a rotating shaft 139 and a support frame 142 transmit the drive power from the motor 31 to the light source 144 so that the light source 144 can laterally move across the width of the transparent running sheet 191 in accordance with an amount of steering operation applied to the steering wheel 77.

When the steering wheel 77 is operated, the moving body 81 will run while changing its direction of travel relative to the image projected on the screen 85 corresponding to a pattern such as a street 192 on the transparent running sheet 191. Also, when the steering wheel 77 is operated, the light source 133 laterally moves across the width of the transparent running sheet 191 in accordance with an amount of steering operation. The transparent running sheet 191 is also selectively driven forward or backward in a longitudinal direction, or stopped based on the position of the operating level 8. Consequently, the moving part 81 can freely run relative to all directions, backward and forward and rightward and leftward, on a projected image corresponding to a portion of a pattern depicted on the transparent running sheet 191.

The above-mentioned and other objects and features of the present invention will become apparent from the following description when read in conjunction with the accompanying drawings.

DETAILED DESCRIPTION OF THE PREFERRED EMBODIMENTS

Figure 1:
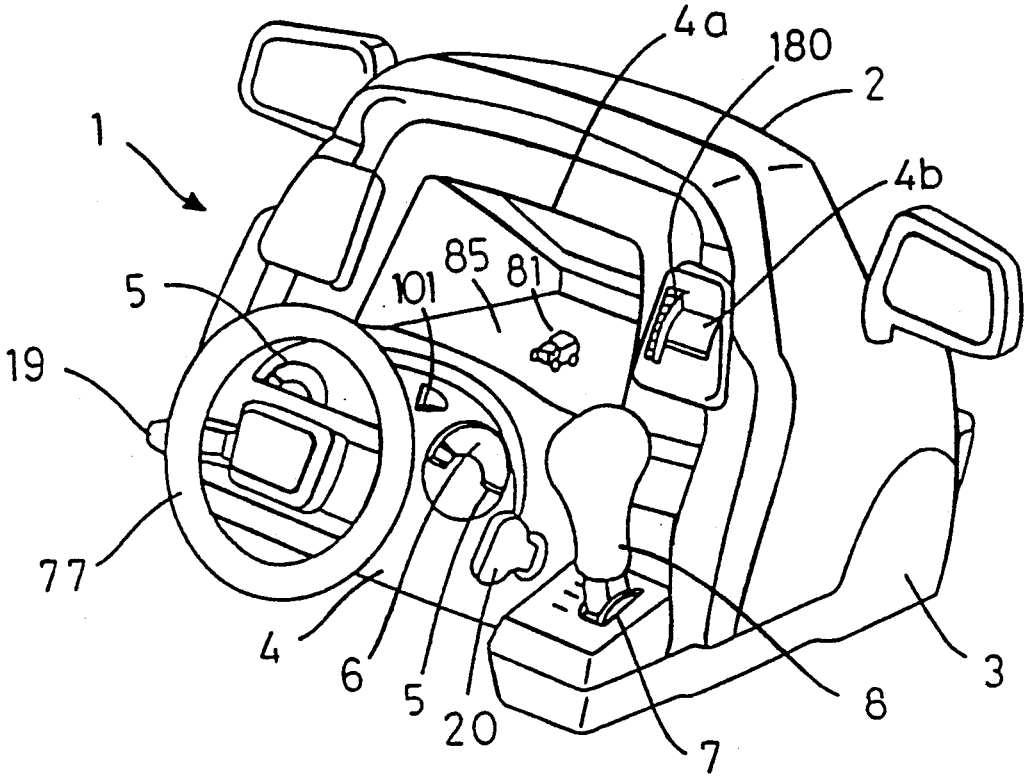
FIG. 1 is a perspective view showing the outline of the drive game device according to an embodiment of the present invention.
Figure 2:
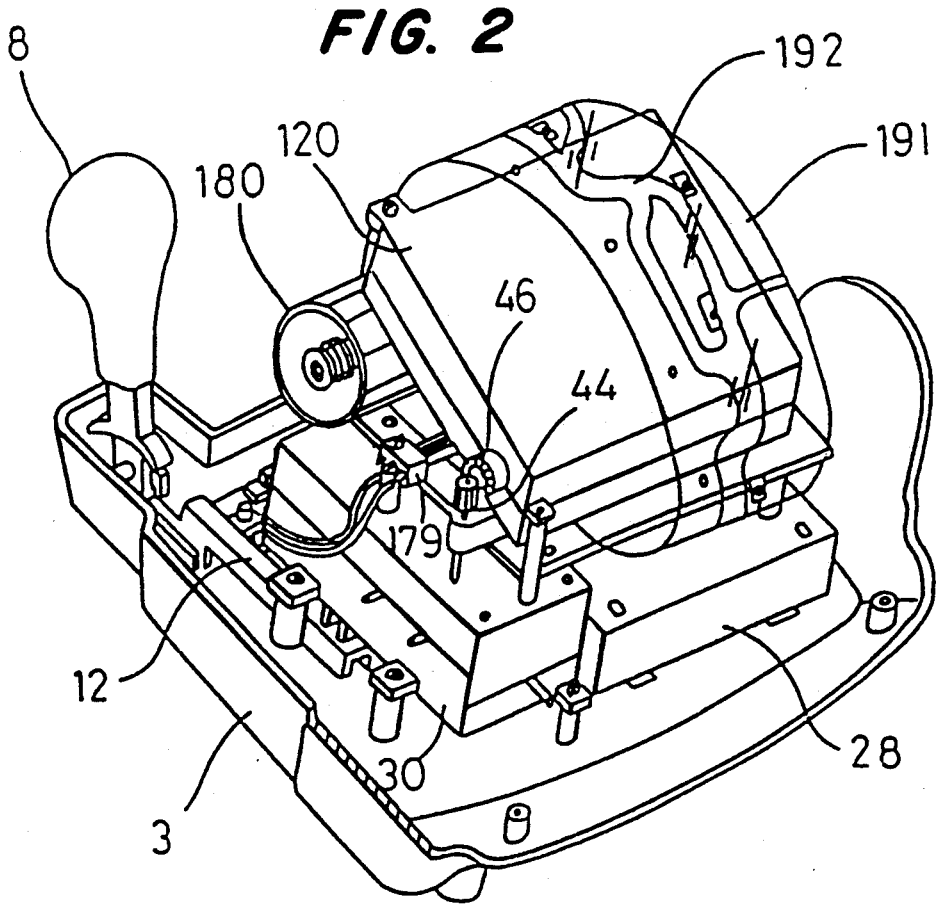
FIG. 2 is a perspective view showing the drive game device with the upper shell removed.

FIG. 1 illustrates the whole body of the drive game device 1 formed in the configuration of, for example, the front section of an actual car. An upper shell 2 of a nearly trapezoid shape and a lower shell 3 having a front panel section 4 are joined by screws. The interior of the upper shell 2 and the lower shell 3 are formed hollow. As illustrated in FIG. 2, the lower shell 3 forms a battery housing section 28. In the battery housing section 28, batteries 29 are removably mounted to power the game device. Also in the vicinity of the battery housing section 28, a frame 30 is fixedly mounted to the lower shell 3. The frame 30 contains a driving mechanism which will be described later.

Figure 3:
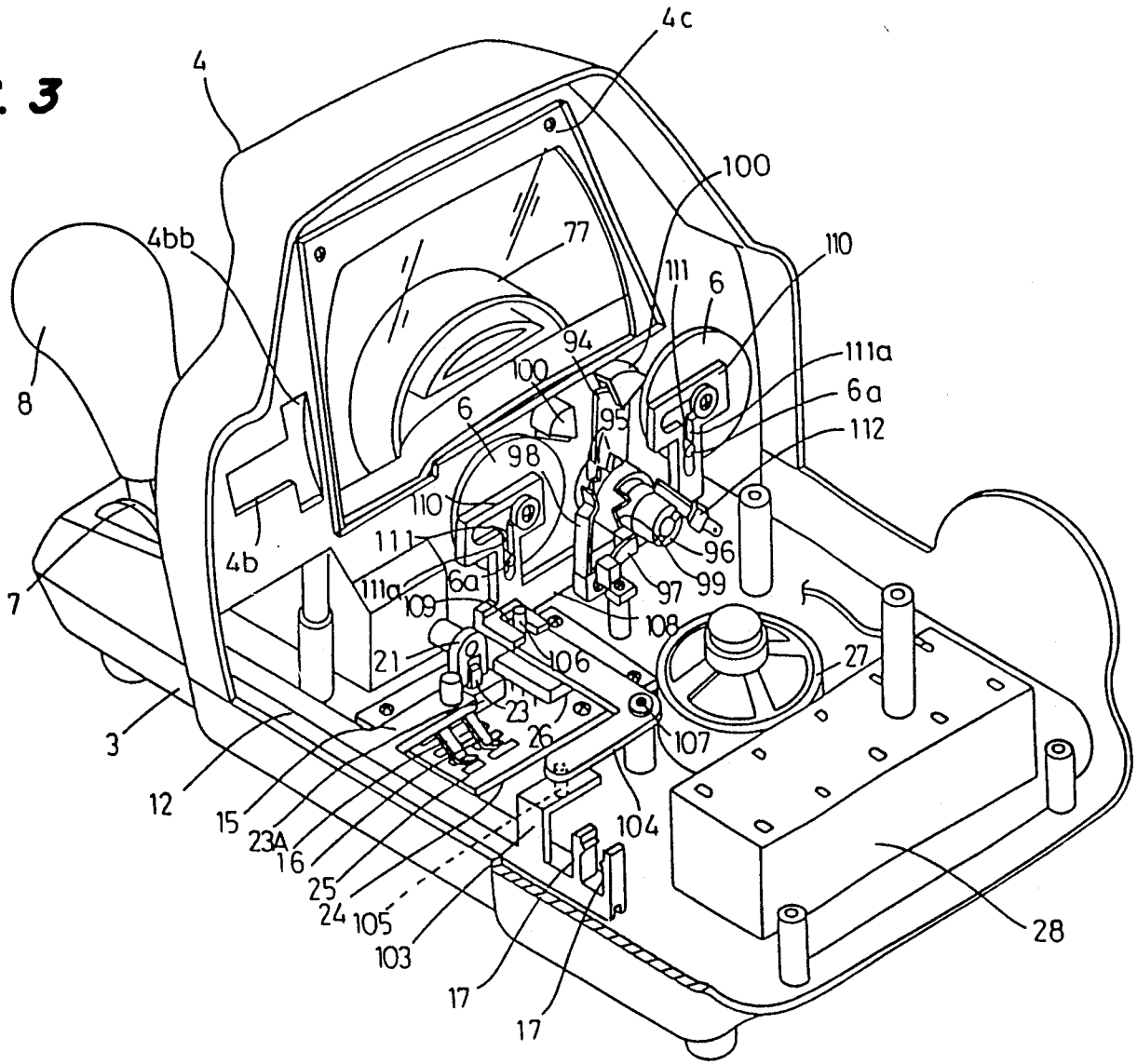
FIG. 3 is a perspective view showing the internal structure of the drive game device.

As illustrated in FIG. 3, a front panel section 4 is formed as an imitation of a dashboard of a car. In the upper part of the central section a square viewing window 4*a* is provided for looking into the interior. A transparent panel 4*d* is fixedly installed in the viewing window 4*a*. Behind the viewing window 4*a*, the screen 85 is horizontally mounted having for example, an opaque white surface. However, the surface could be translucent if the image was projected from beneath rather than above. At the center of the screen 85, a model which resembles a moving body like a car is rotatably mounted. Furthermore, beside the viewing window 4*a* a T-shaped through hole 4*b* is provided.

At the center of the lower part of the front panel section 4, a steering wheel 66 is rotatably mounted for steering the moving body 8 which is rotatably placed on screen 85. On the right of a steering shaft of this steering wheel 77, a turn signal or winker lever 19 is disposed by which the user can signal a direction of forward movement of the moving body 81. Also in the lower part of this front panel section 4, two semi-circular through holes 5 are formed which indicate instruments. Of these two through holes 5, the right through hole 5 is positioned beside ignition key 20.

Furthermore, on the back side of these two through holes 5 formed in the front panel section 4, a pair of rotating disks 6 are rotatably supported. Each of the rotating disks 6 have a red indicating section on the surface which simulates the head of a gauge. A pin 105 is fitted in an L-shaped projecting plate 103 formed on the top of a sliding level 12. The pin 105 attaches to link an L-shaped rocking level 104 which is rockable on a rocking pivot of a pivot section 107. A pin 106 provided on the other end of this rocking level 104 is fitted in a slot 109 formed in a slide plate 108 which is slidable along the back wall surface of the form panel section 4. This slide plate 108 has a pair of erect pieces 110, in each of which is formed a T-shaped fitting hole 111. In each of vertical holes 111*a* making up the fitting holes 111 is fitted each of pins 6*a*, provided on back side of aforesaid pair of rotating disks 6.

Therefore, when the operating level 8 is operated to change the running speed of the transparent running sheet 191, the slide plate 108 slides along the wall surface of the front panel section 4 though the slide lever 12 with the rocking level 104 in interlock with this operating level 8. Thus, the longitudinal holes 111*a* formed in this slide plate 108 guide the pins 6*a* provided in the back side of a pair of rotating disks 6. Accordingly, the pair of rotating disks 6 are turned on the back side of the through holes 5 by an amount equal to the operating position of the operating level. In consequence, the red indicating section provided on the surface of each of the rotating disks 6 is rotatably visible through the through holes 5 and rotates clockwise by an amount of movement indicative of the position of the operating lever 8.

Furthermore, a projection is formed on a side of the front panel section 4. In the opening 7 formed in the upper part of the projection, the operating lever 8 is inserted. The operating lever 8 imitates a gearshift level in such a manner that it can be operated backwardly and forwardly on the supporting point of a pair of supporting shafts 9 as in FIG. 5. The operating lever 8 is provided to effect each control of the running speed, forward and backward operation, and stop of the transparent running sheet 191. The lower end of this operating lever 8 is engaged with the basic end of the slide lever 12.

Figure 4:
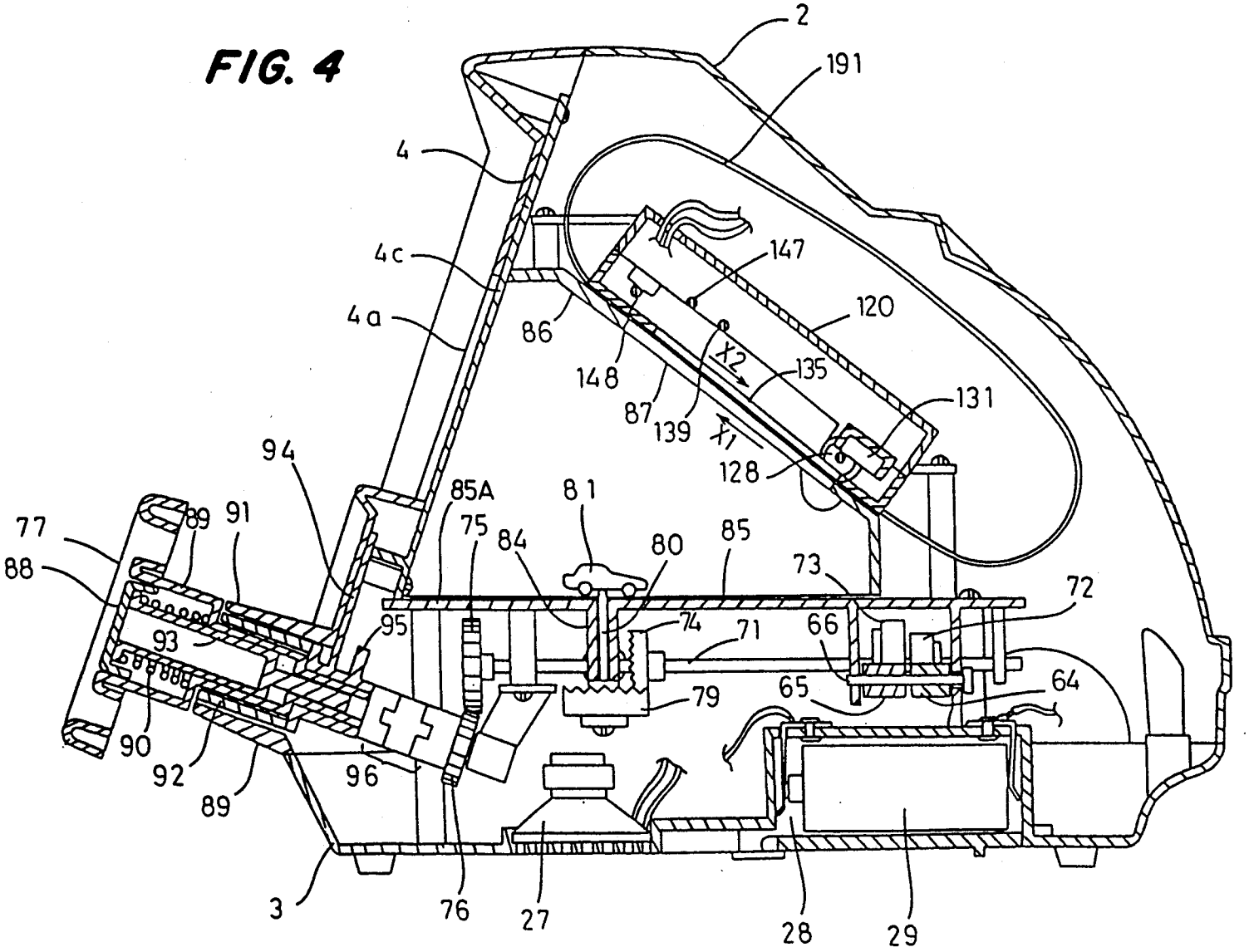
FIG. 4 is a longitudinal sectional view of the drive game device.

As shown in FIG. 4, at the center of the steering wheel 77 a push button 88 is disposed for operating a horn. The push button 88 has a cylindrical pressure member 93, which is fitted in the steering shaft 86, and is always pressed toward the sheering wheel 77 side by means of a compression spring 90 elastically mounted between the pushbutton 88 and the steering shaft 86 described above. An electrical leaf switch 112 is attached to the inner axial tip of cylindrical pressure member 93 which connects to circuit board 24 for operating speaker 27.

The steering shaft 86 formed under the steering wheel 77 is rotatably fitted in a bearing mounting tube 91 formed on the front panel section 4. Between this bearing mounting tube 91 and the steering shaft 86, a rotating tube 92 is rotatably fitted. On the outer periphery of the rotating tube 92 is provided the turn signal level 19 projecting out sidewardly of the steering wheel 77 from a through hole (not illustrated) formed in the bearing mounting tube 91. At the basic end side of this rotating tube 92, a square winker plate 9 rotatably disposed on the back side of the front panel section 4 is fixedly attached as shown in FIG. 3. This winker plate 94 is designed to be rotated in interlock with the turn signal level 19. The forward end of this winker plate 94 can reciprocate between a pair of shielding members 100 disposed at a specific spacing on the back of the front panel 4 and part of through holes 101 formed in the position of the front panel section 4 facing to the pair of shielding members 100 (see FIG. 1). Therefore, as the turn signal or winker lever 19 is operated, the winker plate 94 selectively makes a reciprocating movement between a pair of shielding members 100 and 100 in interlock with the winker plate 94, appearing in either of the pair of through holes 101 and 101 to indicate a right or left turn. Furthermore, on the basic end side of the rotating tube 92 are projectingly provided a pair of projections 99 for depressing the electric turn signal switch 97. With the rightward or leftward operation of the turn signal 19, either of the pair of projections 99 presses the electric turn signal 97 connected to circuit board 24, producing a sound of winker operation warning the operating condition of the turn signal or winker lever 19. The rotating tube 92 is provided, at its basic end, with a plurality of projections 95 elastically engaged with the bent end of the elastic plate 98 in order to position the turn signal lever 19 in a STOP position.

The moving body 81, as previously stated, is controlled by the manipulation of the steering wheel 77. Hereinafter an example of a turn control device to rotate the moving body based on steering force from the steering wheel 77 will be explained.

Figure 5:
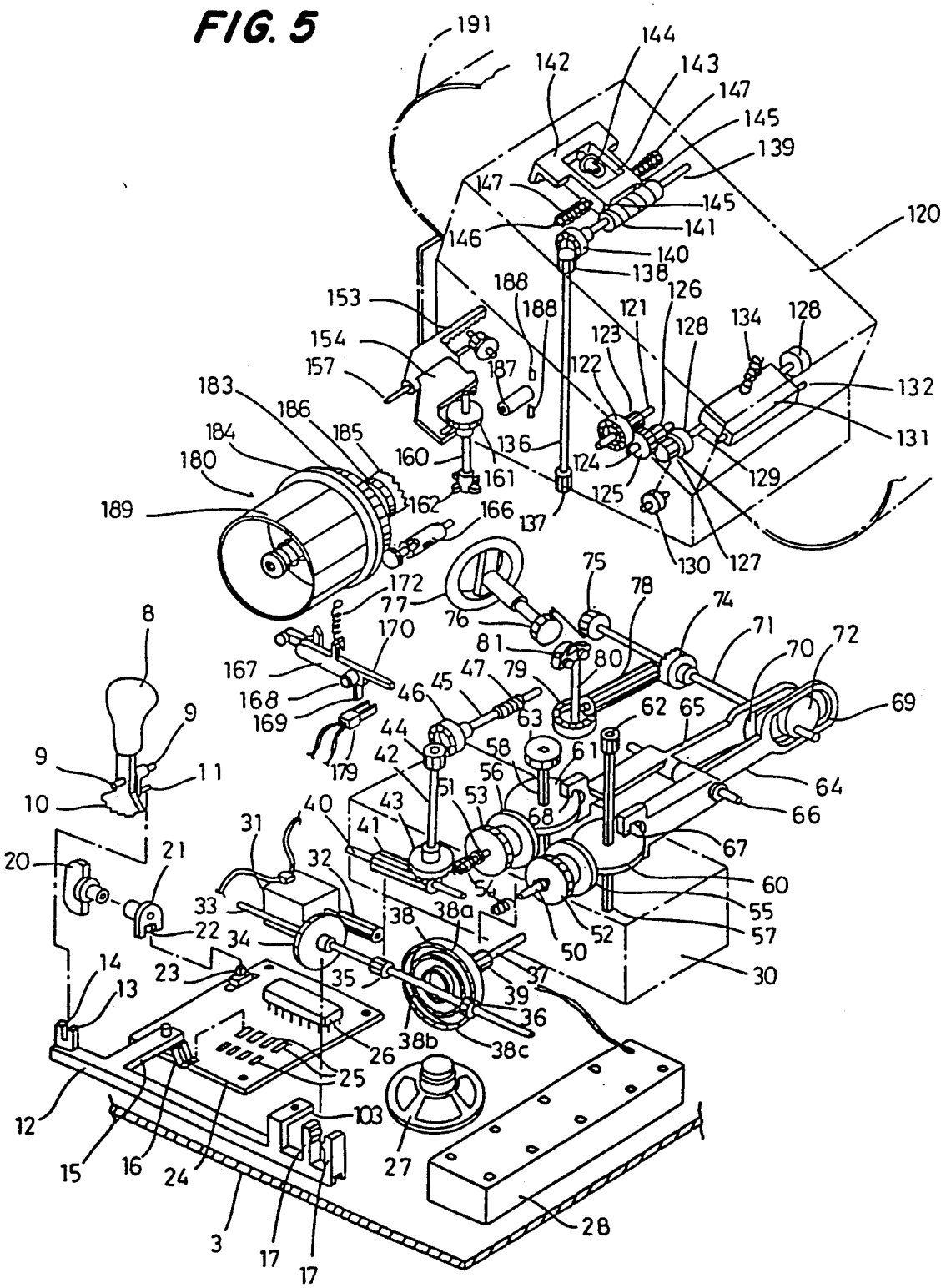
FIG. 5 is a further detailed exploded perspective view of the drive game device.
Figure 6:
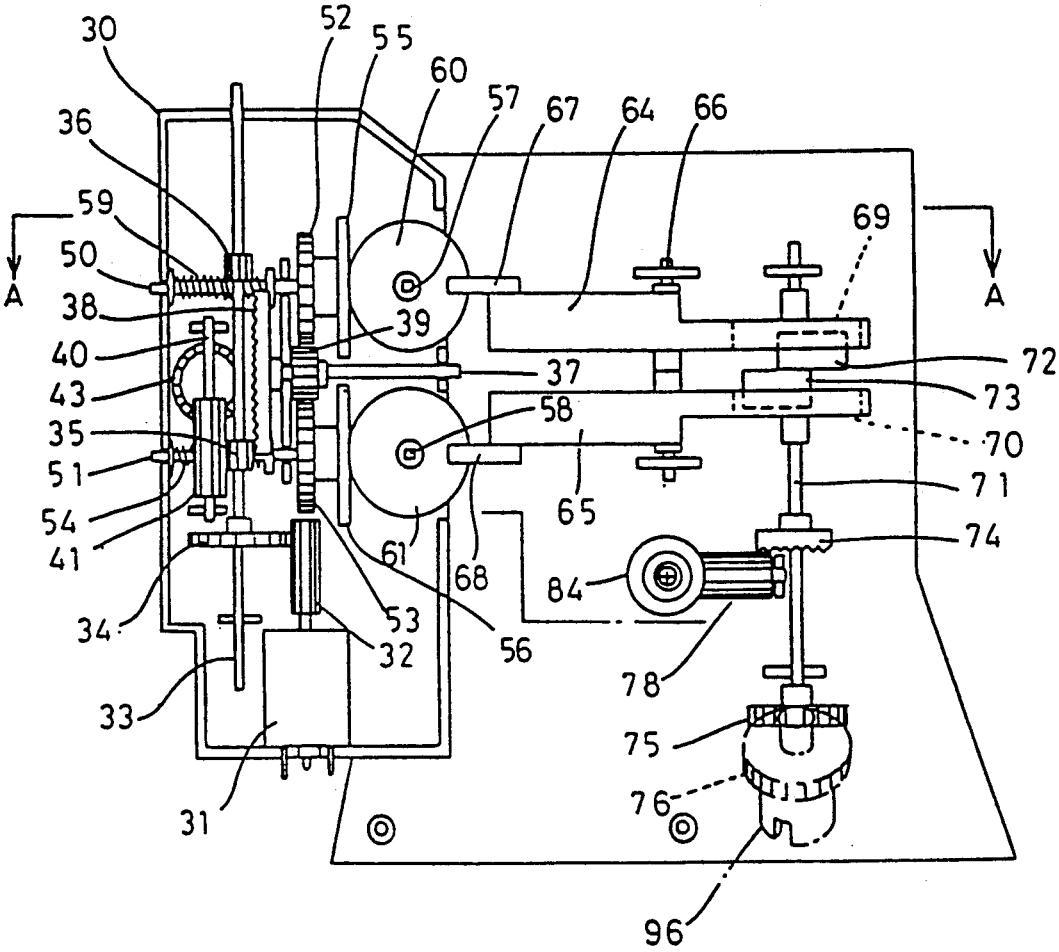
FIG. 6 is a sectional view showing the periphery of a motor, drive mechanism and control mechanism.
Figure 7:
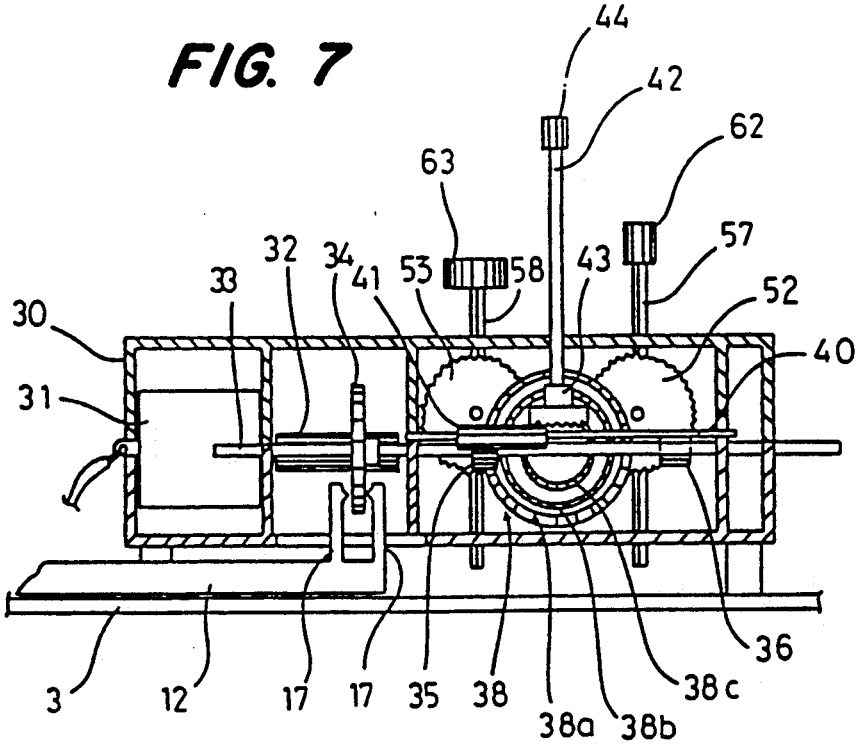
FIG. 7 is a sectional view showing the periphery of a frame containing the drive mechanism.
Figure 8:
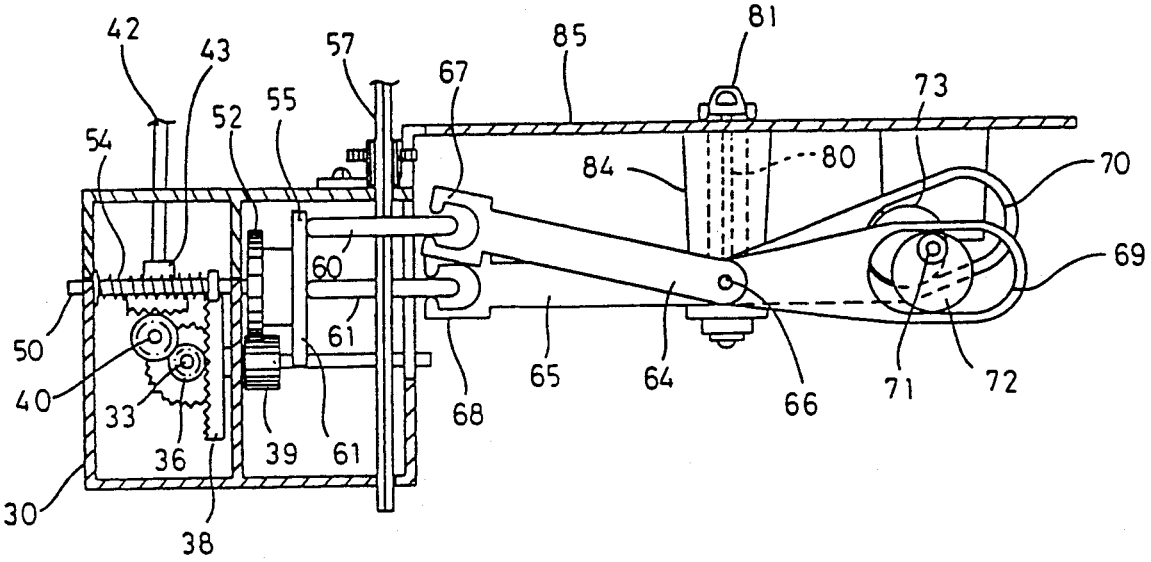
FIG. 8 is a sectional view showing the periphery of the control mechanism.
Figure 9:
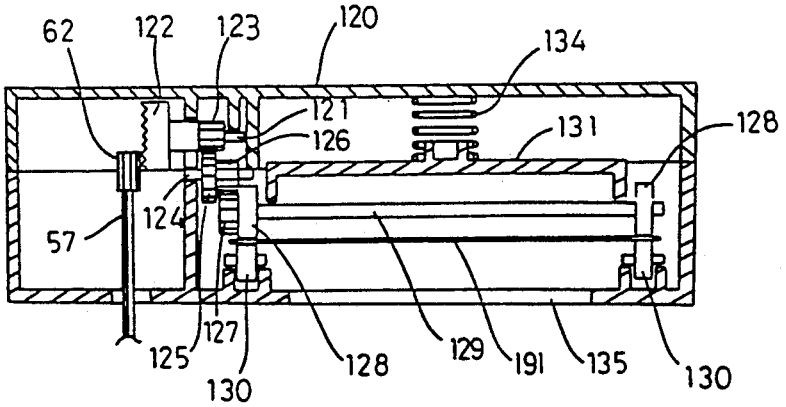
FIG. 9 is a sectional view showing the periphery of a transparent running sheet and a casing.

As shown in FIGS. 4 and 5, a rotating shaft 71 has a pinion 75 in mesh with a gear 76 mounted on the basic end of the steering shaft 86 of the steering wheel 7. A rotating shaft 80 has at its lower end a crown gear 79 in mesh with a crown gear 74 carried on the rotating shaft 71 at the upper end of the moving body 81. The rotating shaft 80 is rotatably inserted in a tube 84 formed integral with the bottom of a screen support plate 85A supporting the screen 85.

Therefore, as the steering wheel 77 is turned, the steering force is transmitted to the steering shaft 86, the rotating shaft 71 and the rotating shaft 80, thereby driving to turn the moving body 81 fixedly attached on the top end of the rotating shaft 80. When the steering wheel 77 is turned 90 degrees clockwise or counterclockwise form a neutral, the moving body 81, as shown in FIG. 4, changes its direction 90 degrees to the right or left of a formed direction on the screen 85 directly in response to the turning of the steering wheel 77. Also, when the steering wheel 77 is turned 180 degrees clockwise or counterclockwise from the neutral position, the moving body 81 is directed in a backward direction on the screen 85.

Next, an example of a driving mechanism for providing drive power for the operation of the transparent running sheet 191 will be explained.

As shown in FIG. 5, a gear shaft 33 carries a gear 34 in mesh with a motor pinion 32 of a motor 31. A crown gear 38 provides a first gear 38*a*, a second gear 38*b* or a third gear 38*c*. The constituent first, second and third gears 38*a*–38*c* of the crown gear 38 mesh with the reverse pinion 35 and the forward pinion 36 which are fixedly attached on the gear shaft 33. Two gear shafts 50 and 51 mesh with a pinion 39 provided integral with the crown gear 38. Through these gear shafts 50 and 51, the moving power transmitting mechanism and the drive power transmitting mechanism, the moving power for moving the moving body 81 in the crosswise direction and the driving power for driving the transparent running sheet are transmitted.

Next, an example of a crosswise drive power transmitting mechanism for transmitting to a support frame 142 power from the motor 31 to move an image of a portion of a pattern on the transparent running sheet 142 in the crosswise direction will be explained.

As shown in FIG. 5, a rotating shaft 71 has a pinion 75 in mesh with the gear 76. Gear 76 is provided on the basic end of the steering shaft 86 of the steering wheel 77 to be manipulated. A crosswise drive rocking lever 65 is rockingly operated by a cam 73 mounted on the rotating shaft 71 to move the moving body in the crosswise direction. A crosswise drive roller 61 moves up and down with the rocking operation of the crosswise drive rocking lever 65 while being pressed in contact with the side surface of the crosswise drive rocking lever 65. A crosswise drive power transmission shaft 58, having a non-circular cross section, is inserted in a though hole defined in the center of the crosswise drive roller 61. A gear shaft 139 having a pinion 137 meshes with a pinion 63 carried on the crosswise drive transmission shaft 58. A worm gear 141 is engaged with a pair of projections 145 formed on one end of a light bulb support frame 142. In this example, the crosswise drive transmission shaft 58 slides freely along the axial direction but rotates with, not around the axis thereof.

Figure 10:
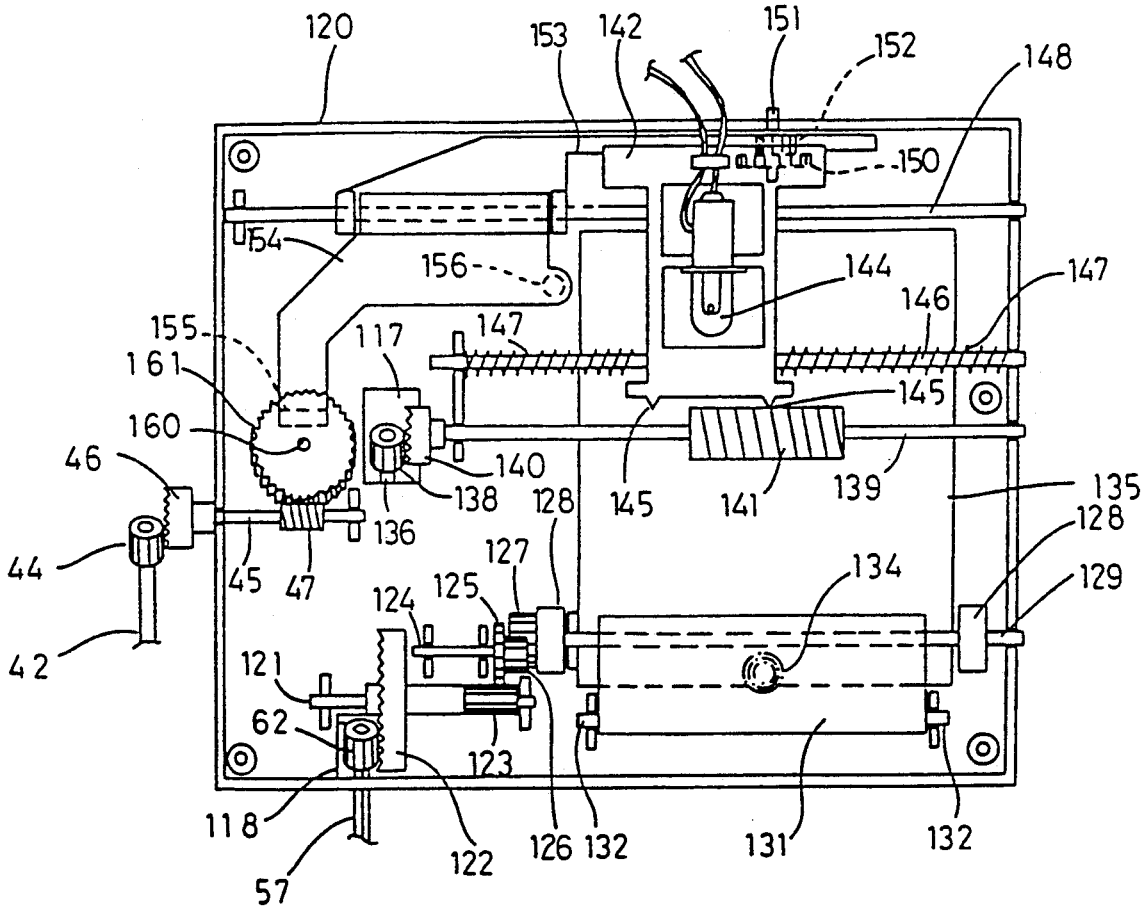
FIG. 10 is a plan view showing the periphery of the transparent running sheet, a moving body, and the casing.

A crosswise drive rotating disk 56 is always pressed in contact with the peripheral surface of the crosswise drive roller 61 by a spring force of the compression spring 30. The drive roller 61 preferably has a rubber ring on its periphery. The rubber ring has a coefficient of friction sufficient for coupling of the drive power between the drive roller 61 and the crosswise drive rotating disk 56. If the peripheral surface of crosswise drive roller 61 moves off the center of the crosswise drive rotating disk 56, the rotary drive power of the motor 31 is transmitted to the gear shaft 139 through the crosswise drive transmission shaft 58 and the gear shaft 136. A pinion gear 138 mounted on the gear shaft 136, as shown in FIG. 10, is in engagement with the crown gear 140 through the through hole 117 formed in a casing 120. Also, the other end of the support frame 142 is slidably supported on a guide shaft 148 mounted in the casing 120 as shown in FIG. 10. Furthermore, the on-off operation of the light source 144 is controlled by means by a power switch 23A whole opening and closing operation is controlled by the ignition key 20.

The crosswise drive power transmitting mechanism having the above-mentioned constitution operates as described below. When the steering wheel 77 is turned, the steering effort is transmitted to the rotating shaft 71 rotatably mounted on the casing 120, through the pinion 75 which is in mesh with the gear 76 mounted on the basic end of the steering shaft 86. Therefore, with the manipulation of the steering wheel 77, the crosswise drive cam 73 and the drive cam 72 (described later) mounted on the rotating shaft 71, shifted 90 degrees in phase from each other, are driven to rotate.

Of the crosswise drive cam 73 and the drive cam 72, the crosswise drive cam 73 is disposed in a long hole 70 formed in the lever end of the crosswise drive rocking lever 63. Therefore, the rotary drive power of the crosswise drive cam 73 is transmitted to the crosswise drive rocking lever 65 through the long hole 70. This crosswise drive rocking lever 65 is rockingly operated on the supporting point of the support shaft 66 rotatably mounted on the frame 30. The rocking drive power of this crosswise drive rocking lever 65 is transmitted to the crosswise drive roller 61 which is held between jaws of a holding piece 68 formed on the forward end of the crosswise drive rocking lever 65. Accordingly, the crosswise drive roller 61 is moved in the axial direction of the crosswise drive transmission shaft 58 which is vertically mounted, by means of the rocking drive power of the crosswise drive rocking lever 65.

With the movement of this crosswise drive roller 61 in the axial direction of the crosswise drive transmission shaft 58, the rotating drive power of the crosswise drive rotating disk 56 which is driven to rotate in interlock with the rotation of the motor 31 is transmitted to this crosswise drive roller 61. Thus, the crosswise drive roller 61 is turned, thereby driving to turn a worm gear 141 mounted on a gear shaft 139 through the crosswise drive transmission shaft 58 which follows the rotation of the drive roller 61. The pinion gear 137 is mounted on the gear shaft 136 to mesh with this crosswise drive transmission shaft 58. The crown gear 82 is attached to gear shaft 139 to mesh with the pinion gear 138 carried on the gear shaft 136. Then, the support frame 142 having projections 145 which are in engagement with the worm gear 141, being movably mounted on a guide shaft 146, is moved in the axial direction of the guide shaft 142 against the spring force of the compression spring 147 installed on the guide shaft 146. Consequently, the support frame 142, together with the light source 144 disposed in the opening section 143 formed in this support frame 142, is controlled to move in the crosswise direction of the transparent running sheet 191. As a result, since the light rays are projected from the light source 144 onto the transparent running sheet 191 which is arranged below the light source 144, the image such as streets depicted on the transparent running sheet 191 can be moved with the movement of this light source 144.

Next, the relative mounting positions of the transparent running sheet 191, the moving body 81 and the viewing window 4a will be explained with reference to FIGS. 4 and 5.

The model 81 is placed on the screen support plate 85A as previously stated. Above the model 81, the support frame 86 is installed. The case 120 with, for example, the endless transparent running sheet 191 wound thereon is fixedly attached to the support frame 86. The transparent running sheet 191 is driven to run between the casing 120 and the support frame 86. This transparent running sheet 191 is partly exposed to the opening section 87 formed at the center of this support frame 86. One end of the support frame 86 is fixedly attached to the upper end of the viewing window 4a and the other end of the support frame 86 is fastened on the battery housing section 28 for the purpose of providing a wide space for housing the moving body enclosed by the support frame 86, the screen support plate 85A and the viewing window 4a.

Next, the drive power transmitting mechanism for transmitting drive power from the motor 31 to the transparent running sheet 191 will be explained.

As shown in FIG. 4, a rotating shaft 71 having the pinion 75 meshes with a gear 79 disposed on the basic end of the steering shaft 86 of the steering wheel 77. A drive rocking lever 64 is rockingly driven by the drive cam 72 mounted on the rotating shaft 71. A running drive roller 60 has a peripheral surface that can be moved on and off the center of the side surface of the drive rotating plate 55 while being pressed in contact therewith in accordance with the rocking position of the drive rocking lever 64.

A drive power transmission shaft 57, having a noncircular cross section, is inserted in a through hole formed in the center of the running drive roller 60. A rotating shaft 121 carrying the crown gear 122 meshes with the pinion 62 mounted on the drive transmission shaft 57. A rotating shaft 124 having a gear 125 meshes with a pinion 123 carried on the rotating shaft 121. A rotating shaft 129 having a gear 127 meshes with a pinion 126 mounted on the rotating shaft 124. A pair of drive rollers 128 are mounted on both ends of the rotating shaft 129. A pair of feed rollers 130 rotate while holding both sides of the transparent running sheet 191 in cooperation with the pair of drive rollers 128. On the outer periphery of each of the pair of drive rollers 128 a rubber ring is fitted. The rubber ring preferably is made of a rubber material having a great coefficient of friction in order to insure smooth running of the transparent running sheet 191. Alternatively, the entire drive roller 128 can be made of a rubber material. The pressure member 131 is always pressed against the rotating shaft 129 by the spring force of the compression spring 134 elastically mounted between the pressure member 131 and the casing 120. Therefore, both sides of the transparent running sheet 191 are elastically held between a pair of drive rollers 128 of the rotating shaft 129 pressed by the pressure member 131 and a pair of feed roller 130. Furthermore, the running drive roller 60 can freely slide in the axial direction of the drive power transmission shaft 57 for driving the transparent running sheet, but can not rotate around the axis of the transmission shaft 57.

In the above, drive power from the motor 31 is transmitted to the rotating shaft 129 through the motor pinion 32, the crown gear 38, a running rotating disk gear 52, the running drive roller 60, the running transmission shaft 57, the rotating shaft 121 and the rotating shaft 124. When the rotating shaft 129 revolves, the rollers 128 on respective ends thereof drive the transparent running sheet 19 which is elastically held by the rollers 128 and the pair of feed rollers 130 around the outer periphery of the casing 120. The speed and direction of the driving of the transparent running sheet 191 is controlled by the manipulation of the steering wheel 77. Namely, when the steering wheel 77 is turned, the steering force is transmitted through rotating shaft 71 rotatably mounted on the frame 30 and through the pinion 75 in mesh with the gear 76 carried on the basic end of the steering shaft 86. Therefore, the running cam 72, which is fixedly attached on this rotating shaft 71 shifted 45 degrees in phase from the crosswise movement cam 73, is driven to turn. The running cam 72 is disposed in the long hole 69 formed in the from the running cam 72, therefore, is transmitted to the running rocking lever 64 through this long hole 69. The running rocking lever 64 is driven to rock on the fulcrum of the support shaft rotatably mounted on the frame 30. The drive power for rocking the running rocking lever 64 is transmitted to the running drive roller 60 which is held by the holding piece 67 formed on the forward end of the running rocking lever 64. The running roller 60, therefore, is moved, by the drive power of the running rocking lever, in the axial direction of the running transmission shaft 57 (drive power transmission shaft) disposed in the vertical direction.

With the movement of the running roller 60 in the axial direction of the running transmission shaft 57, the drive power from the running rotating disk 55, which is driven to rotate directly with the rotation of the motor 31, is transmitted to the running roller 60. The direction of rotation and the speed of rotation of the running roller 60 changes based on the position of contact of the running roller 60 with respect to the center of the side surface of the running rotating disk 55. The change in direction and speed will be described later in relation with the change of direction of the moving body 81 with respect to FIGS. 12(A)–12(F).

As previously stated, the transparent running sheet 191 is driven by the power from the motor 31 and forward, reverse and neutral (stopped) control of the transparent running sheet 191 is done according to the previously stated operation of the operating lever 10.

Next, an example of constitution of the control mechanism for the control of stop and normal and reverse running of the transparent running sheet 191 will be explained.

As shown in FIG. 5, the operation of the operating lever selectively moves a reverse pinion gear 35 and a forward pinion gear 36 carried at a specific spacing on the gear shaft 23, into and away from, engagement with the first gear 38a, the second gear 38b or the third gear 38c, thus controlling the normal, reverse and stop operation of the transparent running sheet 191.

Hereinafter, the operation of this control mechanism will be described in detail. First, when the operation lever 8 is operated, the operating force is transmitted to the slide lever 12 through the pin 11 installed at the basic end of the operating lever 8. Two holding pieces 13 and 14, respectively, hold the pin 11 A gear 34 on the gear shaft 33 is held between two holding pieces 17, thereby moving the gear shaft 3 in the axial direction in accordance with the operation of the operating lever 8.

With the axial movement of the gear shaft 33, the reverse pinion gear 35 and the forward pinion gear 36 mounted at a specific distance on this gear shaft 33 move in the same axial direction, going selectively into engagement with the first gear 38a, the second gear 38b or the third gear 38c on the crown gear 38 for the control of the drive speed and normal and reverse running of the transparent running sheet 191 described above. By the selective engagement of the reverse pinion gear 35 and forward pinion gear 36 with the first gear 38a, the second gear 38b or the third gear 38c, the drive speed and normal and reverse operation of the aforementioned transparent running sheet 191 are controlled.

For example, when the operating lever 8 is set in the neutral position, the crown gear 38 comes to a mid position between the reverse pinion gear 35 and the forward pinion gear 36. In this position, the crown gear 38 is not in mesh with the reverse pinion gear 35 and the forward pinion gear 36, and therefore the drive power from the motor 31 is not transmitted to the crown gear 38. Consequently, the transparent running sheet 191 remains undriven in the stop state.

Also when the operating lever 8 is set in the first-speed position, the forward pinion gear 36 comes into mesh with the first-speed gear 38a provided at the outermost periphery of the crown gear 38, and therefore the drive power of the motor 31 is transmitted to the crown gear 38 through the forward pinion gear 36 and the first-speed gear 38a. Then, the drive power is transmitted to the rotating shaft 129 through the running rotating disk gear 52, the running drive roller 60, the running transmission shaft 57, the rotating shaft 121 and the rotating shaft 124. Consequently, the transparent running sheet 191 is driven at a slow speed in the forward direction (the direction indicated by the arrow X1 in FIG. 4).

Furthermore, when the operating lever 8 is placed in the second-speed position, the forward pinion 36 comes into mesh with the second-speed gear 38b located in the midway position of the crown gear 38. The drive power of the motor 31, therefore, is transmitted to the crown gear 38 through the forward pinion 36 and the second-speed gear 36b, and further to the rotating shaft 129 through the running rotating disk gear 52. Then, the drive power is transmitted to the rotating drive roller 60, the running transmission shaft 57, the rotating shaft 121 and the rotating shaft 124. Consequently, the transparent running sheet 191 is driven to run at a medium speed in the forward direction.

Furthermore, when the operating lever 8 is set in the third-speed position, the forward pinion gear 36 goes away from the crown gear 38 and in turn the reverse pinion gear 35 comes in mesh with the first-speed gear 38a located on the outermost periphery of the crown gear 38. The drive power of the motor 31, therefore, is transmitted to turn the crown gear 38 in the reverse direction, though the reverse pinion 35 and the first-speed gear 36a. The drive power from the crown gear 38 rotating reversely is further transmitted to the rotating shaft 129 through the running gear 52, the running drive roller 60, the running transmission shaft 57, the rotating shaft 121 and the rotating shaft 124. Hence, the transparent running sheet 191 is driven at low and high speeds in the reverse direction (the direction indicated by the arrow X2 in FIG. 4).

When operating the lever 8 is operated to longitudinally slide the slide lever 12 into reverse, neutral, first speed and third speed positions, in this order, a pair of electrically conductive contact segments 16 mounted on the slide lever 12 through the projecting piece 15 selectively come into electrical contact with four conductive patterns 25 arranged on the printed circuit board 24. Corresponding to the position of the operating lever 8, an engine sound (electronic sound) is produced by an electronic sound generator or circuit on printed circuit board 24 attached to the speaker 27. The changeover condition of the operating lever 8 can be audibly judged by a change in the sound volume of the engine sound (electronic sound).

Next, the transparent running sheet 191 driven in interlock with the motor 31 will be explained.

The transparent running sheet 191 is produced of a transparent or translucent thin sheet material, consisting of a wide projection picture 195 and belt-like sensor band 196 as shown in FIG. 1. On the projection picture 195 are depicted a street 192 along which the moving body 81 travels. Facilitates 194, etc. are depicted along this street 192 such as a restaurant, a police station, a market, or the like. Parking lots annexed to these facilities are also illustrated. Target spots 193, etc. are illustrated for each of the facilities 194. The target spots 193, etc., are depicted at a specific distance in the longitudinal direction of the target spots 193, etc., on five equally divided lines in the width direction of the projection picture 195. The sensor band 196 is provided with through holes 197 along the five equally divided lines in the crosswise direction. Each of the through holes 197 are provided in positions that correspond to one of the target spots 193. Preferably, each equally divided line contains only one through hole 197 in a position corresponding to one of the target spots 193. More than five equally divided lines can also be used if more than five target spots 193 are desired.

Next, the drive game mechanism according to a preferred embodiment will be explained with reference to FIGS. 10, 11, 13, 14 and 15.

According to a preferred embodiment of the drive game device, when the steering wheel 77 is operated until the moving body 81 stops (specifically, the pin 156 formed on the slide plate 154, described later, is inserted into the through hole 197) in the position of the target spot 193 (specifically, in the through hole 197 corresponding to this target spot 193) corresponding to a specific designation of the facilities 94 appearing in the through holes 4b, a musical sound is produced for confirmation. Thereafter, the designation of the facility 194 which comes next to stop appears in the through hole 4b. When the steering wheel 77 is operated again to stop the moving body 81 in the position of the target spot 193, corresponding to the designation of the facility 194, the musical sound is produced again for confirmation. Thereafter, designation of the facility 194 where the moving body 81 is to be stopped is indicated in the through hole 4b. In this manner, the steering wheel is manipulated to stop the moving body 81 at the target spots 194 corresponding to the specific designations of the facilities 194 appearing in the though hole 4b, so that the game player can enjoy the game.

Figure 11:
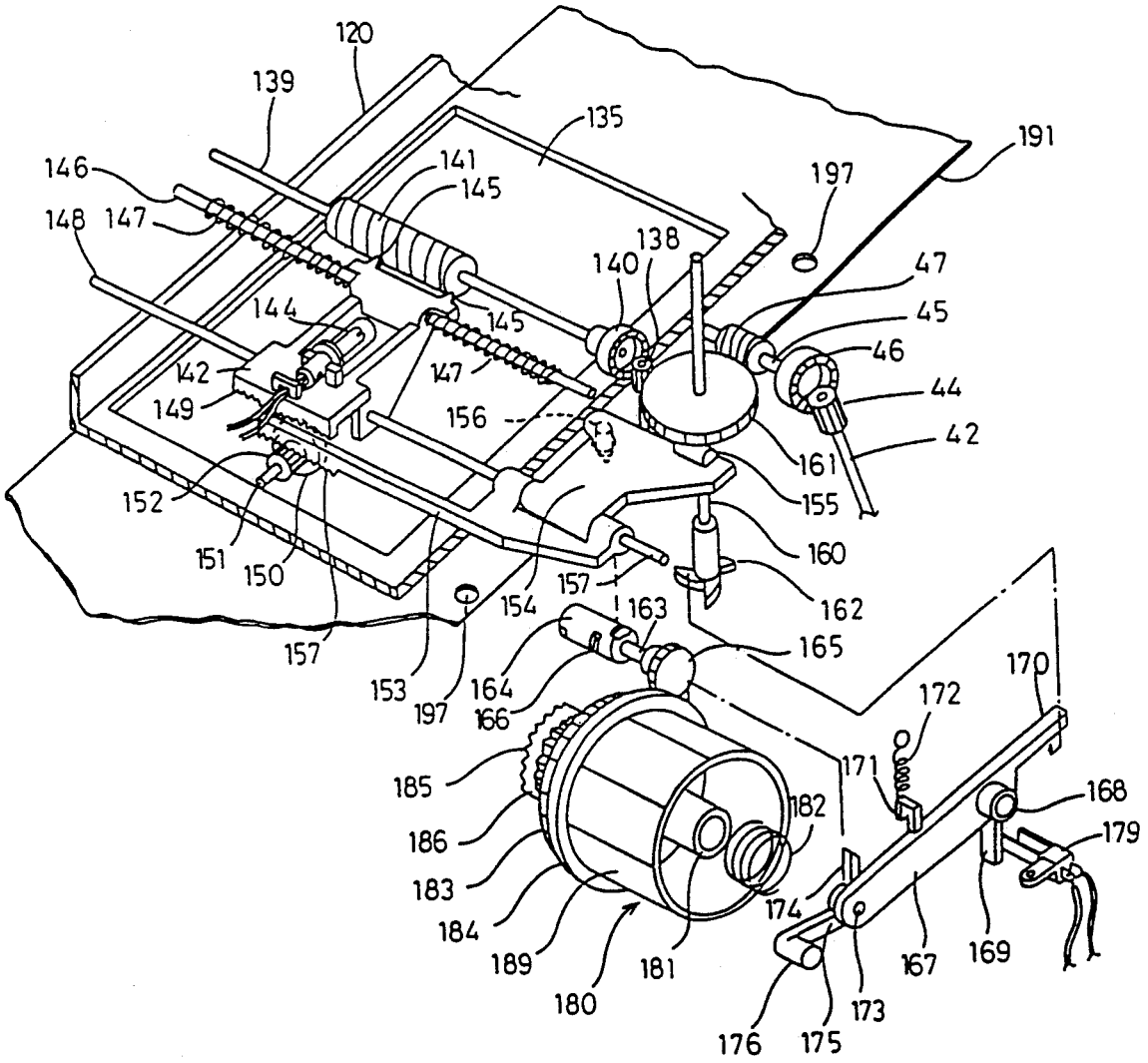
FIG. 11 is an exploded perspective view showing the periphery of the game mechanism.

A rotating drum 180 as illustrated in FIGS. 1 and 11 is provided with a collar 184 at the end thereof so that it may also be manually operated from the longitudinal hole 4b. As illustrated in FIG. 11, on the outer peripheral surface of the rotating drum 180, a plurality of display section 189 are indicated. The display sections indicate, in a specific order, the designations of the facilities 194 such as the restaurant, the police station, etc., depicted on the transparent running sheet 191. When this rotating drum 180 is manually turned to position the designations of the facilities 194 in the through hole 4b, a recess 166 formed in the cam member 164 rotates to come to the corresponding position of the through hole 197 in the sensor band 196.

A guide shaft 148 mounted in the casing 120 is slidably supported on a bearing at the sliding position 154 as shown in FIG. 10. At the forward end of an arm 153, projectingly provided at the front end of this slide plate 154, a rack 157 is formed by cutting (FIG. 11). This rack 157 meshes with a pinion 152 mounted on a gear shaft 151 which is rotatably mounted in the casing 120. A gear 150 is coaxially mounted on the gear shaft 151 as this pinion 152 is in mesh with a rack 149 provided on the forward end of the support frame 142. The gear mechanism described above functions to decelerate and transmit the lateral movement of the support frame 142 to the slide plate 154. By the operation of this deceleration transmission mechanism, the slide plate 154 can proportionally move by one-fifth of the distance through which the support frame 152 traverses.

The slide plate 154 has a projection 155 projectingly formed at the end of its upper surface. At the end of its lower surface there is provided a pin 156 having a conical lower end. The projection 155 is in contact with the lower surface gear 161 which is slidable in the axial direction, pushing the gear 161 up from below. Below this gear 161 is disposed a worm gear 47, which comes into engagement with the gear 161 when the gear 161 moves downwardly. The worm gear 47 is mounted on the gear shaft 45. On the end of the gear shaft 45 is also mounted a crown gear 46, which is in mesh with a pinion 44 carried on the gear shaft 42 which is constantly turned by the power from the motor 31 through a pinion 41 and a crown gear 43. On the other hand, the latter pin 156 is designated to be fitted in a plurality of through holes 197 formed in the transparent running sheet 191. However, when the pin 156 is not fitted in any one of the through holes 197, the slide plate 154 is pressed in the counterclockwise direction shown in FIG. 11 on the center of the guide shaft 148. Thus, the projection 155 pushes up the gear 161, which, therefore, is disengaged from the worm gear 47. In this state, no power from the motor is transmitted to the gear 161.

On the outside surface of the support frame 86 the rotating drum 180 is rotatably supported. Also, on the tubular shaft 181 formed in the rotating drum 180, a compression spring 182 is installed for pressing the rotating drum 180 against the outer peripheral surface of the support frame 86. The compression spring 182 is fastened by a screw to a support shaft (not illustrated) in the tubular shaft 181. Also, on the outside surface of the support shaft frame 86, a rocking lever 167 is pivotally supported which turns on the support of the pivot portion 168. Between a locking piece 171 projectingly provided on the upper surface of the rocking lever 167 and the support frame 86, a tension spring 172 is installed which forces the rocking lever 167 to turn clockwise in FIG. 11 on the support point of the pivot portion 168. Furthermore, on the forward end portion of the rocking lever 168, an L-shaped rocking member 175 is installed which turns on the point of the pivot portion 173. Furthermore, on the other end portion of the rocking member 175 a weight 176 is formed. Also, on the other end portion a locking pawl 174 is formed. The pivot portion 173 has thereunder a projecting piece 169 which is engaged with a sound-producing switch 179. At the time of operation of the rocking lever 168, the sound-producing switch 179 is opened and closed. When the sound-producing switch 179 is closed, the musical sound is produced by the electronic circuit 24 and speaker 27 as the game progresses.

Figure 15:
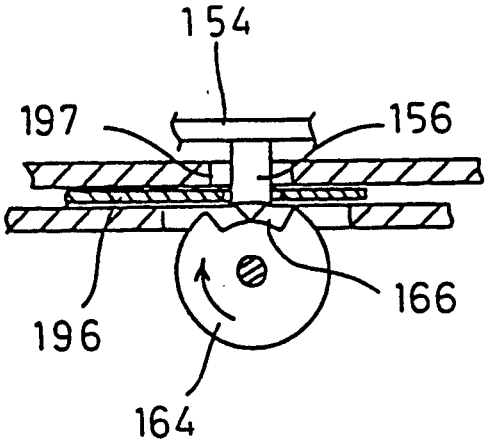
FIG. 15 is a partly sectional view showing the operating condition of the cam member.

A crown gear 185 is projectingly provided at the end face of the rotating drum 180. On the outer peripheral surface of the crown gear 185, an annular locking gear 186 is formed. The crown gear 185 is engaged with a projection (not illustrated) provided on the outer side surface of the support frame 86 to position the rotating drum 180 in the stop position. At the end of the rotating drum 180, a large-diameter gear 183 is formed in mesh with a gear 165 mounted on a gear shaft 163. On the gear shaft 163, a cam member 164 is formed integral with five cam disks disposed in positions corresponding to each of five equally divided courses of the sensor band 196 of the transparent running sheet 191. As shown in FIG. 15, each cam disk comprising the cam member 164 is provided with the recesses 166. The recesses 166 are arranged at a specific spacing in the axial direction and the circumferential direction of the cam member 164. Below the sensor band 196, the cylindrically formed cam member 164 is rotatably mounted across the sensor band 196. Above the cam member 164, a pin 156 is installed on the slide plate in contact with the sensor band 196.

The operation of the aforementioned game mechanism will hereinafter be described below. First, when the steering wheel 77 is operated to move the support frame 142 in the crosswise direction of the transparent running sheet 191 so that, on the screen 85, the moving body 81 comes just at the target spot 193 of the facility 194 indicated in the through hole 4b, the pin 156 formed on the slide plate 154 also moves in the same direction until going into the recess 166 formed in the cam member 164 through a corresponding through hole 197 of the sensor band 196. The slide plate 154, therefore, rotates clockwise in FIG. 11 on the support point of the guide shaft 157. Therefore, the gear 161 and the gear shaft 160 that has been its up position is moved downwardly by the projection 15 of the slide plate 154. The gear 161 then comes into mesh with the worm gear 47, transmitting the drive power of the motor 31 through this worm gear 47 to turn the gear 161. In this case, a plurality of engaging pawls 162, mounted on the lower end portion of the gear shaft 160, rotate in interlock with the gear shaft 160 and come into engagement with the rear end engaging portion 170 of the rocking lever 167. The rocking lever 167 turns counterclockwise as illustrated in FIG. 11 against the tension spring. Thus, the locking pawl 174 formed on the rocking member 175 moves away from a locking tooth 186 of the rotating drum 180 and is ready for locking by the next locking tooth 186. Then, when the steering wheel 77 is operated again, the support frame 142 moves in the crosswise direction of the transparent running sheet 191, and the forward conical end of the pin 156 is engaged with the inner edge of the through hole 197, riding on the upper surface of the sensor band 196. The pin 156, therefore, goes off from the inside of the through hole 197. Accordingly, with the upward movement of the gear shaft 160, the slide plate 154 also moves upwardly, being accompanied by the gear shaft 160. The engaging pawl 162 moves away from the engaging portion 170, and therefore, the rocking lever 167 attached thereto is turned clockwise by the tension spring 173. The locking pawl 174 is then engaged with the next locking tooth 186, rotating the rotating drum 180 through a specific angle. The facility indicated in through hole 4a then changes over to the next facility by stopping rotating drum 180 after rotation through the specific angle.

Next, the steering wheel 77 is operated again to stop the moving body 81 (specifically, the pin 156 formed on the slide plate 154 is inserted) at the target spot 198 (specifically, inside the through hole 197 corresponding to this target spot 193) with respect to the specific designation thus changed and indicated. When the steering wheel 77 is operated as described above, the pin 156 goes into the through hole corresponding to the specific designation. Of the five recesses 166, formed in the cam member 164, a recess 166 with respect to the specific designation is positioned facing to the through hole 197, and the pin 156 passes in the through hole 197, coming in the recess 166. Therefore, the gear 161 and the gear shaft 160 move downwardly in a similar manner as previously stated, and the rocking lever 167 operates in interlock therewith, thereby closing the sound-producing switch 179 to produce the musical sound, whereby the game player can audibly confirm that the moving body 81 has stopped properly. By thus operating the steering wheel 77, it is possible to move the moving body 81 to, and stop at, each of the target spots 193 with respect to the specific facility names as they are changed over and indicated in order, by which the game player can enjoy the game.

If the moving body 81 fails to stop at the target spot 193 with respect to the specific facility name indicated in the through hole 4a and the pin 156 enters the specific through hole 197, the pin 156 will not enter the recess 166 of the cam member 164 corresponding to the specific facility name. Therefore, the projection 155 formed on the slide plate 154 keeps on upwardly pressing against the gear 161 from below. The rocking lever 167, therefore, does not operate to close the sound-producing switch 179 and the musical sound can not be produced. As a result, it is possible to confirm that the moving body 81 is not yet stopped at the position of the target spot 193 corresponding to the specific facility name.

Next, the operation of the drive game device according to the present invention with the steering wheel 77 operated will be explained by referring to FIGS. 12(A) to 12(F).

FIGS. 12(A) to 12(F) schematically show the related operation of the moving body 81, the running rotating disc 55, the crosswise drive rotating disk 56, the running drive roller 60, and the crosswise drive roller 61 at the time when the steering wheel 77 is operated with the operating lever 8 placed in the forward position.

Figures 12A, 12B, 12C, 12D, 12E, 12F:
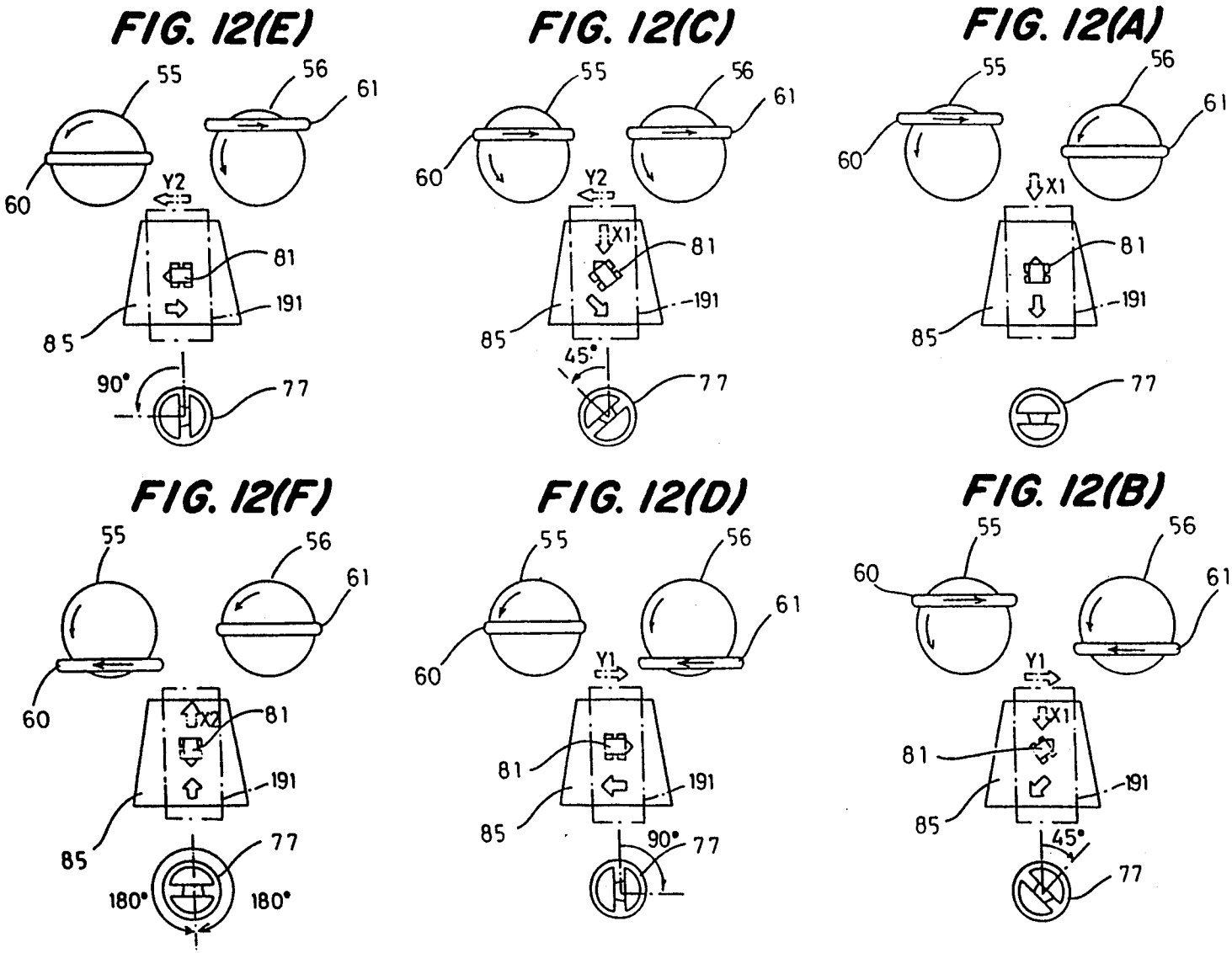
FIGS. 12(A) to 12(F) are schematic illustrations showing the related operation of a running body, a first rotating disk, a second rotating disk, a first roller and a second roller when the steering wheel is operated with the operating lever placed in the forward position.
Figure 13:
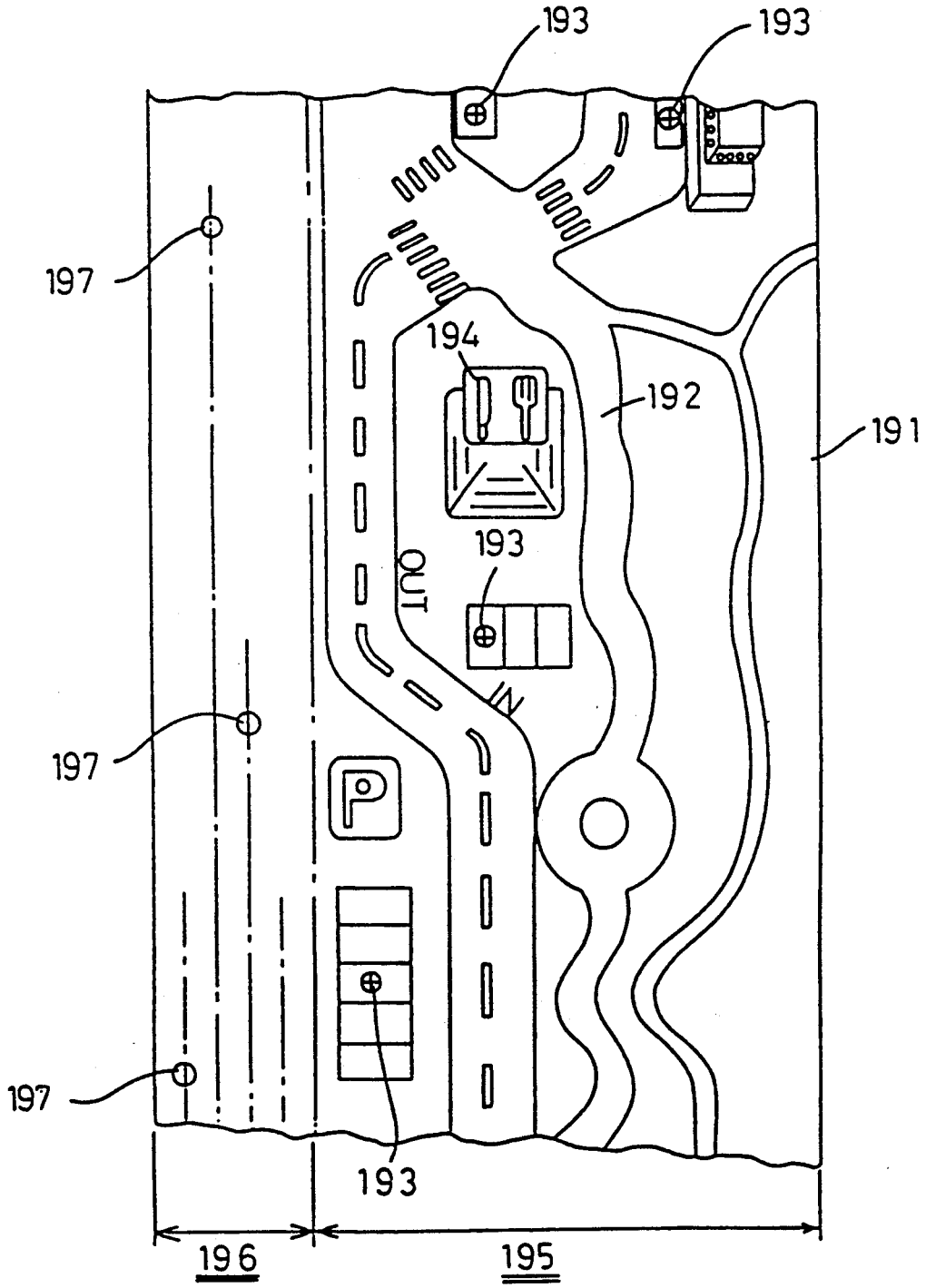
FIG. 13 is an enlarged plan view showing a part of the transparent running sheet.
Figure 14:
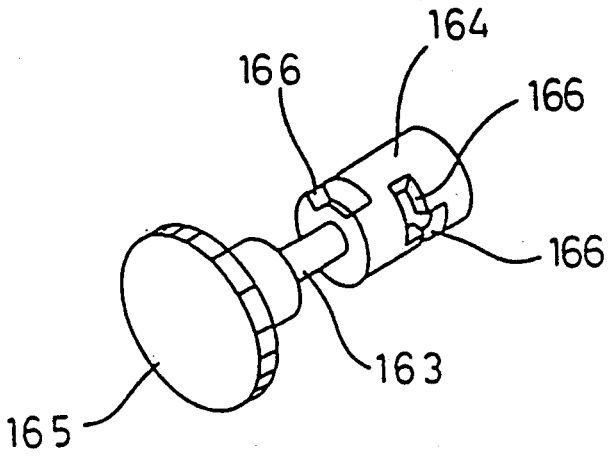
FIG. 14 is a perspective view showing a cam member.

As shown in FIG. 12(A), when the steering wheel 77 is in the neutral position, that is, not turned in either of the clockwise and counterclockwise directions, the moving body 81 is directed in the straightforward position. At this time, the peripheral edge of the crosswise drive roller 61 comes to be pressed against the center of the crosswise drive rotating disk 56. Because the crosswise drive roller 61 is against the center of the crosswise drive rotating disk 56, drive power from the motor 31 is not transmitted to the crosswise drive roller 61. Therefore, the worm gear 141 does not rotate and the light source 144 mounted on the support frame 142 does not move in the lateral direction (in the width direction of the transparent running sheet 191).

The running roller 60 is illustrated in FIG. 12(A) as off the center of the rotating disk 55. Because the running roller 60 is off the center, the drive power of the motor 31 is transmitted to the rotating shaft 85 for driving the running transparent disk 55. Therefore, the drive power of the running rotating disk 55 is transmitted to the running roller 60. In this state, therefore, the rotating shaft 85 is turned at a high speed, thus driving the transparent running 1 sheet 191 at a high speed in the direction of the arrow X1 in the drawing (in the same direction of the arrow X1 in FIG. 12(A)).

Consequently, an image corresponding to the street 192 on the transparent running sheet 191 appearing on the screen 85 by the projection of light rays from the light source 144 mounted on the support frame 142 moves in the direction of the white arrow in FIG. 12(A). When this state is viewed through the viewing window 4a, the moving body 81 looks as if travelling straightforward at a high speed on the street 192.

As shown in FIG. 12(B), when the steering wheel 77 is turned 45 degrees clockwise, the moving body 81 is steered in the relation of 1 to 1 with the steering angle of the steering wheel 77, turning 45 degrees to the right. At this time, the crosswise drive roller 61 moves downwardly off the center of the crosswise drive rotating disk 56 shown in FIG. 12(A), in order to be pressed with the lower part of the crosswise drive rotating disk 56. Therefore, the drive power of the crosswise drive rotating disk 56 which is driven by the power from the motor 31 is transmitted to the crosswise drive roller 61. Therefore, the worm gear 81 is driven to the right (in the direction of the arrow Y1 in FIG. 12(B)).

The running roller 60 in FIG. 12(B) is pressed against the upper part of the running rotating disk 55. The drive power of the running rotating disk 55 which is driven by the power from the motor 31 is transmitted to the running drive roller 60. Accordingly, the rotating shaft 85 is driven at a medium speed, thereby driving the transparent running sheet 191 at a medium speed (in the direction of the arrow X1 in FIG. 12(B)).

Consequently, the image corresponding to the street 192 on the transparent running sheet 191 appearing on the screen 85 by the projection of light rays from the light source 44 mounted on the support frame 142 moves in the direction indicated by a white arrow in FIG. 12(B). When this state is viewed through the viewing window 4a, the moving body as if travelling straightforward at a medium speed, at 45 degrees to the right, on the street 192.

As shown in FIG. 12(C), when the steering wheel 77 is turned 45 degrees counterclockwise, the moving body 81 is directed 45 degrees to the left correspondingly thereto. At this time, the crosswise drive roller 61 moves upwardly from the power position of the crosswise drive rotating disk 56 shown in FIG. 12(B) until the roller 61 is pressed by the upper part of the crosswise drive rotating disk 56. Therefore, the drive power of the crosswise drive rotating disk 56 in interlock with the drive power of the motor 31 is transmitted to this crosswise drive roller 61. Accordingly, the worm gear 141 is driven, moving the light source 144 mounted on the support frame 142 to the left (in the same direction of the arrow Y1 in FIG. 12(C)).

The running roller 60 in FIG. 12(C) is pressed into contact with the upper part of the running rotating disk 55 and the drive power of the running rotating disk 55 which turns in interlock with the motor 31 is transmitted to the running roller 60. In this state, the rotating shaft 85 is driven to rotate at a medium speed, thereby driving the transparent running sheet 191 at a medium speed (in the direction of the arrow X1 in FIG. 12(C)).

As a result, an image corresponding to the street 192 on the transparent running sheet 191 projected on the screen 85 by light rays produced from the light source 144 mounted on the support frame 142 moves in the direction of a white arrow shown in FIG. 12(C), by utilizing a composite vector of the leftward movement (direction of the arrow Y2 in FIG. 12(C)) of the light source 144 and the running of the transparent running sheet 191 (direction of the arrow X1 in FIG. 12(C)). When this state is viewed through the viewing window 4a, the moving body 81 looks as if advancing at a medium speed in a direction 45 degrees leftwards on the street 192.

As shown in FIG. 12(D), when the steering wheel 77 is turned 90 degrees clockwise, the moving body 81 is directed 90 degrees to the right corresponding to this steering wheel manipulation. At this time, the crosswise drive roller 61 moves downwardly from the center position of the crosswise drive rotating disk 56 shown in FIG. 12(C), being pressed at the lowermost part of this crosswise drive rotating disk 56 in interlock with the drive power of the motor 31. Therefore, drive power is transmitted to the crosswise dive rotating disk 56. The worm gear 141 is thus driven to move the light source 144 mounted on the support frame 142 to the right (in the same direction of the arrow Y1 FIG. 12(D)).

The running roller 60 in FIG. 12(D) is pressed at the center part of the running rotating disk 55. Consequently, the drive power of the rotating disk 55 in interlock with the motor 31 is not transmitted to the running roller 60, and accordingly, the rotating shaft 85 similarly does not turn to drive the transparent running sheet 191.

As a result, an image corresponding to the street 192 on the transparent running sheet 191 appearing on the screen 85 by the projection of light rays from the light source 144 mounted on the support frame 142 moves in the direction of the write arrow in FIG. 12(D). When this state is viewed through the viewing window 4a, the moving body 81 looks as if moving 90 degrees to the right on the street 192.

As shown in FIG. 12(E), when the steering wheel 77 is turned 90 degrees counterclockwise, the moving body 81 is directed also 90 degrees to the left correspondingly. At this time, the crosswise drive roller 61 moves upwardly from the center position of the crosswise drive rotating disk 56 shown in FIG. 12(D), thus being pressed against the uppermost part of the crosswise drive rotating disk 56. Accordingly, the drive power of the crosswise drive rotating disk 56 operating in interlock with the drive power of the motor 31 is transmitted to the crosswise drive roller 61. Thus, the worm gear 141 is driven to move the light source 144, mounted on the worm gear 81 to the left (in the same direction of the arrow Y2 in FIG. 12(E)).

The running roller 60 in FIG. 12(E) is pressed against the center part of the running rotating disk 55. Therefore, the drive power of the running rotating disk 55 which operates in interlock with the drive of the motor 31 is not transmitted to the running roller 60. Therefore, the rotating shaft 85 is not driven and the transparent running sheet 191 similarly remains undriven.

Consequently, the image corresponding to the street 192 of the transparent running sheet 192 projected on the screen 85 by the light rays produced from the light source 144 mounted on the support frame 142 moves in a direction indicated by a white arrow shown in FIG. 12(D). When this state is viewed through the viewing window 4a, the moving body 81 looks as if moving to the left, directed 90 degrees leftwardly, on the street 192.

As shown in FIG. 12(F), when the steering wheel 77 is turned a full 180 degrees in either direction from a forward position, the moving body 81 turns correspondingly backward. At this time, the crosswise drive roller 61 moves downwardly to the center from the position of the crosswise drive rotating disk 56 shown in FIG. 12(E). Therefore, the drive power of the crosswise drive rotating disk 56 which operates in interlock with the motor 31 is not transmitted to the crosswise drive roller 61, and the worm gear 81 is not driven. In this state, the light source 144 mounted on the support frame similarly remains stationary.

The running roller 60 illustrated in FIG. 12(F) is pressed at the lowermost part of the running rotating disk 55. Therefore, the drive power of the running rotating disk 55 in interlock with the drive of the motor 31 is not transmitted to the running roller 60. Thus, the rotating shaft 85 is driven at a high speed, thereby driving the transparent running sheet 191 at a high speed (in the direction of the arrow X2 in FIG. 12(F)).

Consequently, an image corresponding to the street 192 on the transparent running sheet 191 projected on the screen 85 by the light rays produced from the light source 144 mounted on the support frame 142 moves in a direction indicated by a white arrow in FIG. 12(F). When this state is viewed through the viewing window 4a, the moving body 81 looks as if travelling, with its tail in front, at a high speed on the street 192.

According to this embodiment of the present invention, when the steering wheel 77 is turned with the operating lever 8 set in the forward position, it is possible to freely move the moving body 81 forwardly, reversely, rightwardly and leftwardly and to make a U-turn, correspondingly to the manipulation of the steering wheel 77.

Similarly, through not particularly illustrated, when, reversely, the steering wheel 77 is operated with the operating lever 8 set in the reverse pinion, the moving body 81 can freely be operated backwardly, leftwardly and rightwardly, and make a U-turn in accordance with the operation of the steering wheel 77.

According to the present embodiment, as described above, it is possible to change the speed and direction of travel of the transparent running sheet 191, the speed of movement of the light source in the width direction (crosswise direction) of the transparent running sheet 191, and the direction of movement of the moving body 81 through 360 degrees, in accordance with the direction and amount of manipulation of the steering wheel 77. Therefore, it is possible to freely run the moving body 81 in any of the backward and forward, rightward and leftward, and oblique directions of the transparent running sheet 191, so that the game player can enjoy the you-are-there realism that he is actually driving a moving body such as a car, a vessel or an airplane.

According to the embodiment explained above, the steering angle of the steering 77 and the angle of change in the direction of travel of the moving body 81 are in the relation of 1 to 1. However, this relation is not necessarily required to be limited to this relation of 1 to 1. Also, in this embodiment, a built-in battery is used as a power source to drive the motor 31 and other components, but this device may be connected with an external battery or external power source, from which the motor may be driven.

As is clear from the above explanation, according to the present invention, because the light source is movable in the width direction of the transparent running sheet and the transparent running sheet is selectively driven in one of the forward and reverse directions, in accordance with the operating position of the operating means, it is possible to freely control the movement and directions of a moving body such an as actual car, vessel, airplane or other flying object back and forth, and right and left, by the manipulation of the steering and control means. Thus, the game player can enjoy the game as if he is actually driving moving body on the street.

While the invention has been illustrated and described in detail in the drawings and foregoing description, it will be recognized that many changes and modifications will occur to those skilled in the art. For example, although the drive roller 61 and the running roller 60 preferably have a rubber ring thereon, the drive rotating disk 56 and running rotating disk 55 can have a rubber surface. Alternatively, the entirety of any of these disks can be made of a material having a sufficient coefficient of friction. It is therefore intended, by the appended claims, to cover any such changes and modifications as fall within the true spirit and scope of the invention.

What is claimed is:

1. A projected image navigation game, comprising:
- a screen surface;
- a steering control;
- a model on said screen surface;
- a transversely movable light source mounted above said screen surface;
- a transparent running sheet having a pattern thereon and mounted between said light source and said screen surface; and
- transverse drive power transmitting means for transversely moving said light source in either a left or a right direction according to a displacement of said steering control to project onto said screen surface a selected portion of the pattern.

2. A projected image navigation game according to claim 1, wherein said transverse drive power transmitting means comprises means for transversely moving said light source at a speed according to an amount of displacement of said steering control and in the left or right direction according to a direction of displacement of said steering control.

3. A projected image navigation game according to claim 2, further comprising longitudinal drive power transmitting means for longitudinally moving said transparent running sheet in either a forward or backward direction according to the direction of displacement of said steering control.

4. A projected image navigation game according to claim 3, wherein said longitudinal drive power transmitting means comprises means for longitudinally moving said transparent running sheet at a speed according to the amount of displacement of said steering control and in the forward or reverse direction in accordance with the direction of displacement of said steering control.

5. A projected image navigation game according to claim 4,
- wherein the game further comprises an operating means for simulating a gear shift leaver of a vehicle;
- wherein said transverse drive power transmitting means comprises means for transversely moving said light source at a speed according to an amount of displacement of both said steering control and said operating means and in the left or right direction according to a direction of displacement of both said steering control and said operating means; and
- wherein said longitudinal drive power transmitting means comprises means for longitudinally moving said transparent running sheet at a speed according to the amount of displacement of both said steering control and said operating means and in the forward or reverse direction in accordance with the direction of displacement of both said steering control and said operating means.

6. A projected image navigation game, comprising:
- a screen surface;
- a steering control;
- a model on said screen surface; above said screen surface;
- a transparent running sheet having a pattern thereon and mounted between said light source and said screen surface; and
- a transverse drive power transmission comprising a worm gear operatively coupled between said steering control and said transversely movable light source, a selected portion of the pattern on said transparent running sheet being projected onto said screen surface in dependence upon a transverse position of said light source.

7. A projected image navigation game according to claim 6, wherein said transparent running sheet is mounted with respect to said screen surface at a pitched angle so that the projected image on said screen surface appears to coverage towards a vanishing point.

8. A projected image navigation game according to claim 6, further comprising a transparent window mounted above and at an angle with said screen surface.

9. A projected image navigation game according to claim 6, further comprising:
- a motor; and
- a longitudinal drive power transmission comprising at least one longitudinal power gear operatively coupled between said motor, said steering control and said transparent running sheet.

10. A projected image navigation game according to claim 9, wherein said transparent running sheet is formed as a continuous belt.

11. A projected image navigation game according to claim 9, further comprising:
- a rotating shaft connected to said model along an axis reigning through said screen surface;
- a first gear mounted on said first rotating shaft; and
- a second gear coupled to said steering control and in mesh with said first gear.

12. A projected image navigation according to claim 9, further comprising a gear shift leaver pivotably coupled between said motor and said transverse and longitudinal drive power transmissions.

13. A projected image navigation game according to claim 12, further comprising:

a driving mechanism coupled between said motor and said longitudinal and transverse drive power transmissions, comprising:

a drive shaft slidably connected with said pivotably mounted gear shift leaver:

a reverse pinion gear mounted on said drive shaft;

a forward pinion gear mounted on said drive shaft; and a plurality of speed selecting gears, one of said speed selecting gears selectively meshing with one of said reverse and formed pinion gears.

14. A projected image navigation game according to claim 9, wherein said transverse drive power transmission further comprises a first variable speed and direction coupling coupled between said motor and said worm gear, comprising:

a first drive rotating disk having a first axially perpendicular surface; and a first peripheral surface with a center in contact with the first axially perpendicular surface and movably coupled to said steering control to move the first peripheral surface on and off the center of the first axially perpendicular surface.

15. A projected image navigation game according to claim 14, wherein said transverse drive power transmission further comprises:

a first cam rotatingly coupled to said steering control; and a first drive rocking lever rockingly coupled on a first end to said first cam and slidably coupled on a second end to said first drive roller to move the first peripheral surface of said first drive roller on and off the center of the first axially perpendicular surface 16. A projected image navigation game according to claim 14, wherein said longitudinal drive power transmission further comprises a second variable speed and direction coupling coupled between said motor and said at least one longitudinal power gear, comprising:

a second drive rotating plate having a second axially perpendicular surface; and a second drive roller having a second peripheral surface with a center in contact with the second axially perpendicular surface and movably coupled to said steering control to move the second peripheral surface on and off the center of the second axially perpendicular surface.

17. A projected image navigation game according to claim 16, wherein said longitudinal drive power transmission further comprises:

a second cam rotatingly coupled to said steering control with a different timing than said first cam; and a second drive rocking lever rockingly coupled on a first end to said first cam and slidably coupled on a second end to said second drive roller to move the second peripheral surface of said first drive roller on and off the center of the first axially perpendicular surface.

18. A projected image navigation game according to claim 6, wherein said transparent running sheet comprises a sensor band comprising a plurality of through holes; and wherein said game further comprises:

a slide plate proportionately, transversely and movably coupled to said transverse drive power transmission; and a pin having a shape corresponding in size with at least one of said through holes and attached to said slide plate above said sensor band of said transparent running sheet.

19. A projected image game according to claim 18, wherein said plurality of through holes are placed along a plurality of equally divided lines in the sensor band of said transparent running sheet; and wherein said game further comprises:

a cam member mounted below said sensor band of said transparent running sheet and having a plurality of recesses having a shape corresponding in size with a least one of said through holes and said pins and corresponding to the plurality of equally divided lines;

an indicator couplable to said slide plate to indicate when one of said pins passes through one of said through holes and into a corresponding one of said recesses.

20. A projected image game according claim 19, wherein said indicator comprises a rotating drum having a plurality of visually identifiable display sections thereon and couplable to said cam member.

* * * * *

UNITED STATES PATENT AND TRADEMARK OFFICE

CERTIFICATE OF CORRECTION

PATENT NO. : 5,106,102

DATED : April 21, 1992

INVENTOR(S) : Mitsumoto

It is certified that error appears in the above-identified patent and that said Letters Patent is hereby corrected as shown below:

Col. 8, line 16, "19" should be --191--;

line 29, after "the" (first occurrence) insert --basic end of the running rocking lever 64. The drive power--.

Col. 9, line 8, "11" should be --11.--;

line 10, "3" should be --33--.

Col. 14, line 57, after "body" insert --81 looks--.

Col. 18, (claim 6, line 33), after "surface;" begin a NEW PARAGRAPH and insert --a transversely movable light source mounted--.

Signed and Sealed this

Third Day of August, 1993

Michael K. Kirk

MICHAEL K. KIRK

*Acting Commissioner of Patents and Trademarks*

*Attest:*

*Attesting Officer*